US005426941A

United States Patent [19]

Lewis

[11] Patent Number: 5,426,941

[45] Date of Patent: Jun. 27, 1995

[54] VAPOR CONDENSATION AND LIQUID RECOVERY SYSTEM

[76] Inventor: Stan Lewis, 2350 W. Shaw Ave., Suite 103, Fresno, Calif. 93711

[21] Appl. No.: 229,318

[22] Filed: Apr. 18, 1994

[51] Int. Cl.[6] ..... F01K 9/00

[52] U.S. Cl. ..... 60/693; 60/694; 165/71; 165/112

[58] Field of Search ..... 60/693, 694; 165/13, 165/32, 12, 112, 71

[56] References Cited

U.S. PATENT DOCUMENTS

| | | | |
|---|---|---|---|
| 2,496,041 | 1/1950 | Dickey | 60/693 |
| 3,251,408 | 5/1966 | Watson et al. | 165/71 |
| 3,660,980 | 5/1972 | Knirsh et al. | 60/685 |
| 3,731,488 | 5/1973 | Sasakura et al. | 60/95 |
| 3,820,334 | 6/1974 | Heller et al. | 60/688 |
| 3,825,060 | 7/1974 | Heller et al. | 165/71 |
| 4,455,135 | 6/1984 | Bitterly | 432/1 |
| 4,476,684 | 10/1984 | Phillips | 60/693 |
| 4,506,508 | 3/1985 | Coers et al. | 60/652 |
| 4,517,804 | 5/1985 | Ura et al. | 60/657 |
| 4,677,827 | 7/1987 | Shenoy et al. | 60/648 |
| 4,833,688 | 5/1989 | Smith | 374/42 |

FOREIGN PATENT DOCUMENTS

| | | | |
|---|---|---|---|
| 0835419 | 5/1960 | United Kingdom | 60/693 |

*Primary Examiner*—Ira S. Lazarus
*Assistant Examiner*—L. Heyman

[57] ABSTRACT

A vapor condensation and liquid recovery system is provided where a turbine chamber is connected to a multi-chambered condensation unit. Each chamber of the condensation unit has a valved inlet port and a valved outlet port. The valved inlet ports of each chamber of the condensation unit are connected to the turbine chamber outlet. Each condensation chamber is provided with another valved port which is connected to a vacuum generating means. Each chamber is also provided with a further valved port connected to a purge pump. The valved outlet ports are connected to a fluid reservoir. All of the valves are opened and closed by valve control means such as a computer. The valve control means opens and closes the valved vacuum line, valved inlet ports, valved outlet ports, and valved purge line in a sequence to permit a condensable vapor to be continuously drawn through the turbine chamber where it rotates the turbine blades transferring energy from the vapor to the turbine shaft. As a result the vapor condenses. The condensate is further sequentially drawn into the condensation chambers by the negative pressure therein. The automatic sequence of valves opening and closing is such that one condensation chamber is always filling with condensate, one condensation chamber is always being evacuated and one condensation chamber is always being drained of condensate through the use of positive pressure supplied by a purge pump. The turbine shaft may be connected to a generator.

24 Claims, 2 Drawing Sheets

VAPOR CONDENSATION AND LIQUID RECOVERY SYSTEM

BACKGROUND OF THE INVENTION

Field of the Invention

The present invention relates generally to a vapor condensation and liquid recovery system, and more particularly, to a vapor condensation system which employs a turbine and multi-chambered condensation units which are sequentially evacuated, filled and purged.

It is often desirable to separate a liquid from a solid material containing the liquid. Techniques which apply heat to solid materials in order to vaporize and extract the liquids contained therein are called thermal desorbtion processes. In most cases of environmental interest water is the primary liquid contained in the solid matrix, which is usually soil. When soils contain hazardous or toxic substances such as fuel oils, gasolines, hydrocarbons, chlorinated organic compounds, or other volatile or semi-volatile chemicals the vapor streams extracted are normally oxidized in specially designed combustion chambers to completely destroy the hazardous molecules and emit combustion products which are environmentally benign relative to their precursors.

There are cases, however, when emissions of the combustion products are not desirable. This would be due to either legal or regulatory restrictions, nominally, when the combustion products are themselves toxic or hazardous. There are also such cases where such volatile or semi-volatile liquids have commercial value.

The apparatus disclosed herein is designed to condense vapors into liquids, and, thus, permit the condensate to be recycled or destroyed as desired.

SUMMARY OF THE INVENTION

To achieve the foregoing and other advantages, the present invention, briefly described, pertains to a vapor condensation and liquid recovery system where a turbine chamber is connected to a multi-chambered condensation unit. Each chamber of the multi-chambered condensation unit has a valved inlet port and a valved outlet port. The valved inlet ports of each chamber of the multi-chambered condensation unit are connected by piping or similar structure to the turbine chamber outlet. Each condensation chamber is provided with another valved port which is connected by piping or other similar structure to a vacuum generating means such as an evacuating pump. Each chamber is also provided with a further valved port connected by piping or other similar structure to a purge pump. The valved outlet ports are connected to a fluid reservoir by piping or other similar structure. All of the valves are opened and closed by valve control means such as a computer or spring actuators sensitive to differential pressure. The valve control means opens and closes the valved vacuum line, valved inlet ports, valved outlet ports, and valved purge line in a sequence to permit a condensable vapor to be continuously drawn through the turbine chamber where it rotates the turbine blades transferring energy from the vapor to the turbine shaft. As a result of this loss of energy the vapor condenses. The condensate is further sequentially drawn into the condensation chambers by the negative pressure therein. The automatic sequence of valves opening and closing is such that one condensation chamber is always filling with condensate, one condensation chamber is always being evacuated (having vacuum established) and one condensation chamber is always being drained of condensate through the use of positive fluid pressure supplied by a purge pump into the reservoir when the automatic valve sequence has achieved a steady state. The reservoir also includes a valved port connected by piping to the vacuum generating means. This reservoir valved port is also controlled by said valve control means and is utilized in the establishment of a vacuum in the reservoir during the initial start up sequence of the apparatus. The turbine shaft may be connected to a load such as a generator or blower.

A minimum of three chambers are required; however, more may be utilized. In one of the three chamber embodiments, each chamber has four different valved ports which may be computer controlled or spring actuated by differential pressure between the chambers and structures in communication said chambers. They include a valved condensate input or entrance port, a valved condensate output or exit port, a valved vacuum port and a valved purge port. The valved condensate input port is connected to the turbine exit, the valved condensate output port is connected to the reservoir. The valved purge port is connected to a purge pump and the valved vacuum port is connected to a vacuum pump.

The valved condensate input port of each condensation chamber is connected by piping or other similar structure to the turbine exit. This piping is in communication with each of the condensation chambers and in the three chamber embodiment has three branches from the turbine. Each branch of the condensate line connects to the valved condensate input port of each chamber.

The valved vacuum port of each condensation chamber is connected by piping or other similar structure to a vacuum pump. This piping is in communication with each of the condensation chambers and in the three chamber embodiment has three branches from the vacuum pump. Each branch of the vacuum line connects to the valved vacuum port of each chamber.

The valved purge port of each condensation chamber is connected by piping or other similar structure to a purge pump. This piping is in communication with each of the condensation chambers and in the three chamber embodiment has three branches from the purge pump. Each branch of the purge line connects to the valved purge port of each chamber.

The valved condensate output port of each condensation chamber is connected by piping or other similar structure to the reservoir. The piping is in communication with each of the condensation chambers and in the three chamber embodiment has three branches connecting the valved output port of each chamber to the reservoir.

The valved reservoir port is connected by piping or other similar structure to the vacuum generating means.

The vapor condensation and liquid recovery system utilizes a four phase operational sequence of valve states for the three chamber embodiment. The addition of another chamber will require the addition of another phase for the sequence of valve states. There may be more than two condensation chambers present in the present invention and more than three condensation chambers may be provided. It is envisioned that an embodiment incorporating one chamber would include the same valve dynamics with slightly different actuation timing. The additional condensation chambers are structurally identical to the condensation chambers discussed herein and the valves thereon are responsive to the selected control means. The valve state matrix is explained in detail in the description of the preferred embodiment.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is an object of the present invention to provide a vapor condensation and liquid recovery system which utilizes a turbine to transfer energy from the vapor to the turbine shaft such that a portion of the energy expended in vapor generation is recovered in the condensation process.

It is still a further object of the present invention is to provide a vapor condensation and liquid recovery system which utilizes valve sequencing to continuously drive the turbine.

Still a further object of the present invention is to provide a vapor condensation and liquid recovery system including means for collecting the condensate.

Still a further object of the present invention to provide a vapor condensation and liquid recovery system which may be easily and efficiently manufactured and marketed.

It is a further objective of the present invention to provide a vapor condensation and liquid recovery system which is of durable and reliable construction.

An even further object of the present invention is to provide a vapor condensation and liquid recovery system which is susceptible of a low cost of manufacture with regard to both materials and labor, and which accordingly is then susceptible of low prices of sale to the consuming public, thereby making such a vapor condensation and liquid recovery system available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved vapor condensation and liquid recovery system embodying the principles and concepts of the present invention will be described.

Figure 1:
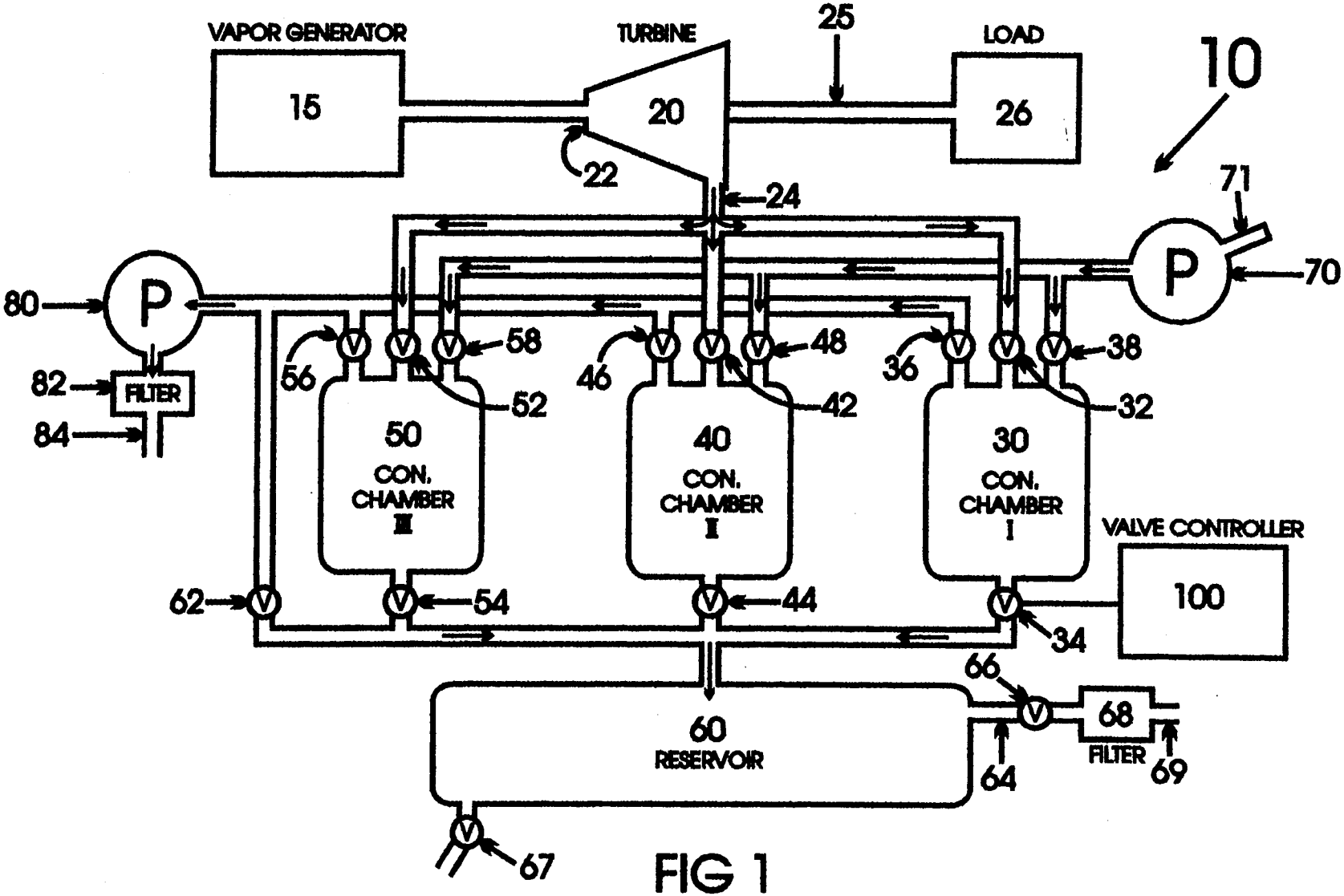
FIG. 1 is a cross-sectional view showing the preferred embodiment of the vapor condensation and liquid recovery system of the invention.

Referring to FIG. 1 there is shown the exemplary embodiment of the vapor condensation and liquid recovery system of the invention generally designated by reference numeral 10. In its preferred form, vapor condensation and liquid recovery system 10 comprises generally a turbine 20 inside a housing having a turbine housing inlet 22 and a turbine housing outlet 24. A turbine shaft 25 may be connected to a load 26. The turbine housing inlet 22 is connected by piping to a vapor generating means 15. The turbine housing outlet 22 is connected by piping or other similar structure to a first condensation chamber 30, a second condensation chamber 40, and a third condensation chamber 50. A valved inlet port 32 is provided on the first condensation chamber 30, a valved inlet port 42 is provided on the second condensation chamber 42 and a valved inlet port 52 is provided on the third condensation chamber 50. The valved inlet ports 32, 42, and 52 each include a valve which is actuated (opened or closed) in a predetermined sequence depending on which phase of operation the system is utilizing.

A valved outlet port 34 is provided on the first condensation chamber 30. A valved outlet port 44 is provided on the second condensation chamber 40. A valved outlet port 54 is provided on the third condensation chamber 50. The valve outlet ports 34, 44, and 54 each include a valve which is actuated (opened or closed) in a predetermined sequence depending on which phase of operation the system is utilizing.

A reservoir 60 is connected by piping to the first condensation chamber 30, the second condensation chamber 40, and the third condensation chamber 50. The reservoir 60 includes a valved port 62. The reservoir 60 is connected by piping or other similar means to a vacuum pump 80. The reservoir 60 also includes a vent 64 to the atmosphere to prevent overpressurization of the reservoir 60. A safety valve 66 is provided intermediate between the reservoir 60 and a vapor scrubbing means 68. Said vapor scrubbing 68 means may include an adsorption filter or oxidizer. The safety valve 66 will open when the pressure in the reservoir exceeds some critical value. The reservoir acts as a further cooling means and the vapor scrubbing means 68 acts to removed all non-condensed vapors prior to elimination through reservoir exhaust 69 to the atmosphere. An exit valve 67 is included to permit removal of condensates from the reservoir for further processing or storage.

The vacuum pump 80 is connected by piping or other similar structure to the first condensation chamber 30, the second condensation chamber 40, and the third condensation chamber 50. A valved vacuum port 36 is provided on the first condensation chamber 30, a valved vacuum port 46 is provided on the second condensation chamber 40 and a valved vacuum port 56 is provided on the third condensation chamber 50. The valved vacuum ports 36, 46 and 56 each include a valve which is actuated (opened or closed) in a predetermined sequence depending on which phase of the operation the system is utilizing. The vacuum pump 80 is also connected to a vapor scrubbing means 82. Said vapor scrubbing means may include an adsorption filter or oxidizer and will remove substantially all non-condensed vapors from the air stream prior to elimination to the atmosphere through exhaust 84.

The purge pump 70 is connected by piping or other similar structure to the first condensation chamber 30, a second condensation chamber 40 and a third condensation chamber 50, and includes purge pump inlet 70. A valved purge port 38 is provided on the first condensation chamber 30, a valved purge port 48 is provided on the second condensation chamber 40, and a valved purge port 58 is provided on the third condensation chamber 50. The valved purge ports 38, 48 and 58 each include a valve which is actuated (opened or closed) in a predetermined sequence depending on which phase of the operation the system is utilizing.

Valves are controlled by a central valve control means 100. Said valve control means may be a computer which uses a signal generation protocol to provide an on/off actuation signal to open/close valves as required to sustain the process. Certain valves, when the device is operating in a steady-state mode, will be spring actuated due to differential pressure between the chambers and the structures in communication therewith. However, such does not obviate the need for computer control at start-up and shut-down. The pressure state inside the various structures will be monitored in real-time via signals from pressure transducers in communication with valve control means 100. The pressure data communicated is included in the signal generation protocol to determine optimal times for valve sequencing.

The following tables show the phase of operation of the system, the valves states at that point and the sequence of valve actuation during the operation of the vapor condensation and liquid recovery system.

Referring now to Tables 1–5, with respect to the valved elements described in FIG. 1, the sequence of operation is described. Table 1 refers to the situation during the start up phase of the sequence. In the start-up phase of operation of the vapor condensation and liquid recovery system, all of the condensation chambers 30, 40, and 50 are evacuated to an initial sub-ambient pressure $P_O$. The initial valve states are described in Table 1.

TABLE 1

| VALVE STATES AT START UP | | |
|---|---|---|
| VALVE | VALVE STATE | LOCATION OF VALVE |
| 32 | CLOSED | FROM TURBINE TO CHAMBER |
| 34 | CLOSED | FROM CHAMBER TO RESERVOIR |
| 36 | OPEN | VACUUM MEANS TO CHAMBER |
| 38 | CLOSED | FROM PURGE MEANS TO CHAMBER |
| 42 | CLOSED | FROM TURBINE TO CHAMBER |
| 44 | CLOSED | FROM CHAMBER TO RESERVOIR |
| 46 | OPEN | FROM VACUUM MEANS TO CHAMBER |
| 48 | CLOSED | FROM PURGE MEANS TO CHAMBER |
| 52 | CLOSED | FROM TURBINE TO CHAMBER |
| 54 | CLOSED | FROM CHAMBER TO RESERVOIR |
| 56 | OPEN | FROM VACUUM MEANS TO CHAMBER |
| 58 | CLOSED | FROM PURGE MEANS TO CHAMBER |
| 62 | OPEN | FROM EMPTY RESERVOIR TO VACUUM MEANS |

Referring now to Table 2 a vapor is generated in the vapor generating means 15 through the application of heat to a material containing a liquid. Thus the vapor diffuses through the turbine inlet 22 to the turbine 20, where the valved vacuum ports 36, 46, 56 and 62 are closed. Valved vacuum port 62 is always closed except at the start-up. Valved inlet port 32 is opened and the pressure drop across the turbine inlet 22 and turbine outlet 24 causes the vapor to expand into the turbine 20, causing the turbine 20 to rotate and thus transferring energy from the vapor to the turbine shaft 25. This process is called the Initiation Sequence. The valve states are depicted in Table 2.

TABLE 2

| INITIATION SEQUENCE | | |
|---|---|---|
| VALVE | VALVE STATE | LOCATION OF VALVE |
| 32 | OPEN | FROM TURBINE TO CHAMBER |
| 34 | CLOSED | FROM CHAMBER TO RESERVOIR |
| 36 | CLOSED | FROM VACUUM MEANS TO CHAMBER |
| 38 | CLOSED | FROM PURGE MEANS TO CHAMBER |
| 42 | CLOSED | FROM TURBINE TO CHAMBER |
| 44 | CLOSED | FROM CHAMBER TO RESERVOIR |

TABLE 2-continued

| | | INITIATION SEQUENCE |
|---|---|---|
| VALVE | VALVE STATE | LOCATION OF VALVE |
| 46 | CLOSED | FROM VACUUM MEANS TO CHAMBER |
| 48 | CLOSED | FROM PURGE MEANS TO CHAMBER |
| 52 | CLOSED | FROM TURBINE TO CHAMBER |
| 54 | CLOSED | FROM CHAMBER TO RESERVOIR |
| 56 | CLOSED | FROM VACUUM MEANS TO CHAMBER |
| 58 | CLOSED | FROM PURGE MEANS TO CHAMBER |
| 62 | CLOSED | FROM RESERVOIR TO VACUUM MEANS |

The next sequence, Sequence #1, described in Table 3, initiates when the pressure in the first condensation chamber 30 reaches a final value $P_f$. The pressure may be transduced by any of a variety of pressure sensors. Valved inlet port 32 is closed and valved inlet port 42 is opened to allow for a concurrent process. Valved purge port 38 is opened to allow the pressure to increase in the first condensation chamber 30 to achieve some purge pressure $P_p$, and then valved outlet port 34 is opened to purge the liquid and vapor contents of the first condensation chamber 30 into the reservoir 60. The valve states for Sequence #1 are described in Table 3.

TABLE 3

| | | SEQUENCE #1 |
|---|---|---|
| VALVE | VALVE STATE | LOCATION OF VALVE |
| 32 | CLOSED | FROM TURBINE TO CHAMBER |
| 34 | OPEN | FROM RESERVOIR TO CHAMBER |
| 36 | CLOSED | FROM VACUUM MEANS TO CHAMBER |
| 38 | OPEN | FROM PURGE MEANS TO CHAMBER |
| 42 | OPEN | FROM TURBINE TO CHAMBER |
| 44 | CLOSED | FROM RESERVOIR TO CHAMBER |
| 46 | CLOSED | FROM VACUUM MEANS TO CHAMBER |
| 48 | CLOSED | FROM PURGE MEANS TO CHAMBER |
| 52 | CLOSED | FROM TURBINE TO CHAMBER |
| 54 | CLOSED | FROM RESERVOIR TO CHAMBER |
| 56 | CLOSED | FROM VACUUM MEANS TO CHAMBER |
| 58 | CLOSED | FROM PURGE MEANS TO CHAMBER |
| 62 | CLOSED | FROM RESERVOIR TO VACUUM MEANS |

The next sequence, Sequence #2, described in Table 4, may have two possible configurations depending upon the purge rate of the first condensation chamber 30 relative to the fill rate of the second condensation chamber 40. In Table 4, the purge rate of the first condensation chamber 30 is greater than the fill rate of the second condensation chamber 40. In this case, the first condensation chamber 30 is being evacuated while the second condensation chamber 40 is still filling. The third condensation chamber is still evacuated awaiting it's turn in the cycle.

TABLE 4

| | | SEQUENCE #2 |
|---|---|---|
| VALVE | VALVE STATE | LOCATION OF VALVE |
| 32 | CLOSED | FROM TURBINE TO CHAMBER |
| 34 | CLOSED | FROM RESERVOIR TO CHAMBER |
| 36 | OPEN | FROM VACUUM MEANS TO CHAMBER |
| 38 | CLOSED | FROM PURGE MEANS TO CHAMBER |
| 42 | OPEN | FROM TURBINE TO CHAMBER |
| 44 | CLOSED | FROM RESERVOIR TO CHAMBER |
| 46 | CLOSED | FROM VACUUM MEANS TO CHAMBER |
| 48 | CLOSED | FROM PURGE MEANS TO CHAMBER |
| 52 | CLOSED | FROM TURBINE TO CHAMBER |
| 54 | CLOSED | FROM RESERVOIR TO CHAMBER |
| 56 | CLOSED | FROM VACUUM MEANS TO CHAMBER |
| 58 | CLOSED | FROM PURGE MEANS TO CHAMBER |
| 62 | CLOSED | FROM RESERVOIR TO VACUUM MEANS |

The next sequence, SEQUENCE #3, described in Table 5, allows for the second condensation chamber 40 to be purged while the third condensation chamber 50 is being evacuated and the first condensation chamber 30 is being filled.

TABLE 5

| | | SEQUENCE #3 |
|---|---|---|
| VALVE | VALVE STATE | LOCATION OF VALVE |
| 32 | CLOSED | FROM TURBINE TO CHAMBER |
| 34 | CLOSED | FROM RESERVOIR TO CHAMBER |
| 36 | OPEN | FROM VACUUM MEANS TO CHAMBER |
| 38 | CLOSED | FROM PURGE MEANS TO CHAMBER |
| 42 | CLOSED | FROM TURBINE TO CHAMBER |
| 44 | OPEN | FROM RESERVOIR TO CHAMBER |
| 46 | CLOSED | FROM VACUUM MEANS TO CHAMBER |
| 48 | OPEN | FROM PURGE MEANS TO CHAMBER |
| 52 | OPEN | FROM TURBINE TO CHAMBER |

TABLE 5-continued

| VALVE | VALVE STATE | SEQUENCE #3 LOCATION OF VALVE |
|---|---|---|
| 54 | CLOSED | FROM RESERVOIR TO CHAMBER |
| 56 | CLOSED | FROM VACUUM MEANS TO CHAMBER |
| 58 | CLOSED | FROM PURGE MEANS TO CHAMBER |
| 62 | CLOSED | FROM RESERVOIR TO VACUUM MEANS |

The process is then continued cyclically with the vapor providing energy to rotate the turbine shaft 25 which may be connected to a load 26. At the conclusion of the process the condensation chambers 30, 40 and 50 are left in an empty state. The condensate in the reservoir 60 is drained to be treated or stored.

Figure 2:
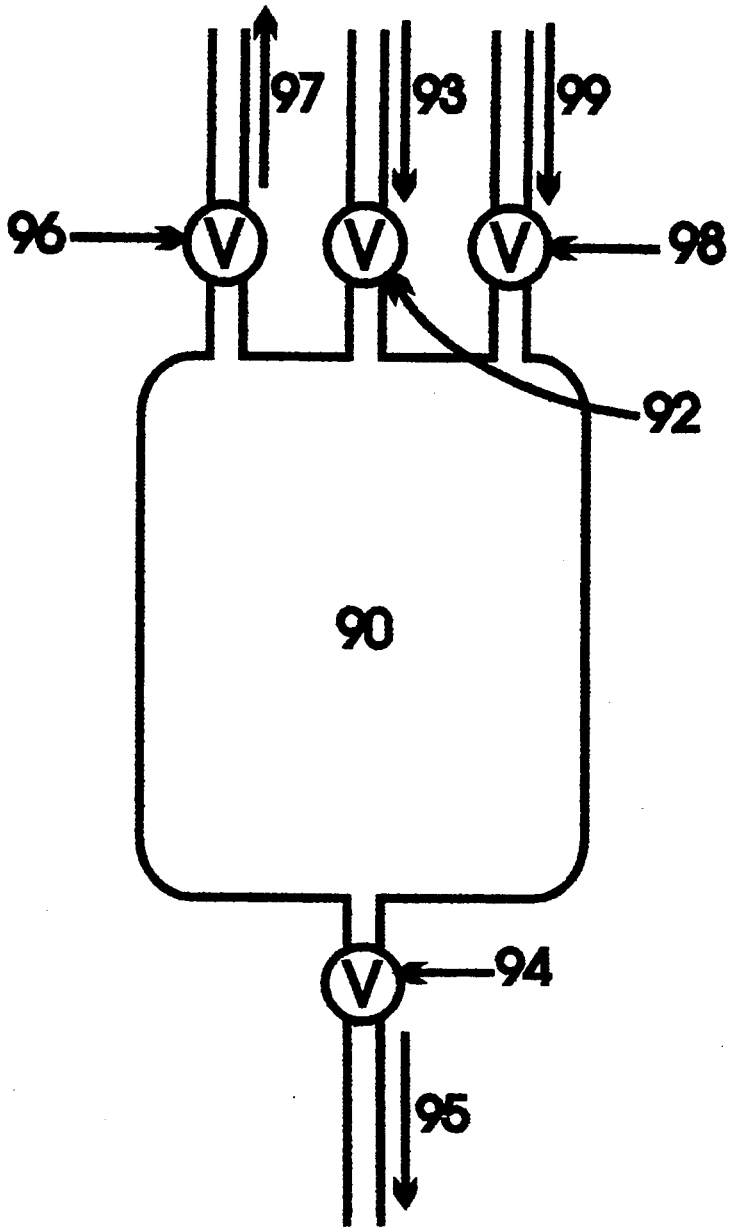
FIG. 2 is a cross-sectional view of the valved port arrangement of a generic condensation chamber of the instant invention.

Referring now specifically to FIG. 2, a condensation chamber 90 is shown. This is a generic condensation chamber which may be added to the vapor condensation and liquid recovery system shown in FIG. 1. A valved inlet port 92 is shown which includes a valve which may be operated in a predetermined sequence by valve control means 100. Valve 92 may also be spring actuated according to the differential pressure between the vapor generating means (15 in FIG. 1) and the chamber 90. Arrow 93 designates the direction of flow from the turbine. A valved outlet port 94 is shown which includes a valve which may be operated in predetermined sequence by the valve control means 100. Valve 94 may also be spring actuated according to the differential pressure between the reservoir (60 in FIG. 1) and the chamber 90. Arrow 95 designates the direction of flow from the condensation chamber 90 to the reservoir (60 in FIG. 1). A valved vacuum port 96 is shown which includes a valve which would be operated in predetermined sequence by valve control means 100. Arrow 97 designates the direction of flow from the condensation chamber 90 to the vacuum generating means. A valved purged port 98 is shown which includes a valve is operated in a predetermined sequence by the valve control means 100. Arrow 99 indicates the direction of flow from the purge pump to the condensation chamber.

It is apparent from the above that the present invention accomplishes all of the objectives set forth by providing a vapor condensation and liquid recovery system which utilizes a turbine to transfer energy from the vapor to the turbine shaft, which utilizes valve sequencing to continuously drive the turbine, and permits the condensation of the vapor as well as the collection of the condensate.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

I claim:

1. A vapor condensation and liquid recovery system comprising;

vapor generating means;

a turbine;

at least three condensation chambers;

said condensation chambers having a valved inlet means and a valved outlet means;

said valved inlet means having an open and closed position;

said valved outlet means having an open and closed position;

said valved inlet means operatively connected by connection means to said turbine;

a vacuum generating means;

said condensation chambers having a first valved port means;

said first valved port means having an opened and closed position;

said first valved port means operatively connected by connection means with said vacuum generating means;

a positive fluid pressure generating means;

said condensation chambers having a second valved port means;

said second valved port means having an opened and closed position;

said second valved port means operatively connected by connection means to said positive fluid pressure generating means;

a reservoir; said reservoir operatively connected by connection means to said valved outlet means;

a valve control means for controlling said valved inlet means, said valved outlet means and said first valve port means, and said second valved port means, whereby said valve control means opens and closes said first valved port means, said second valved port means, said valved inlet means and said valved outlet means in a sequence permitting a vapor to be continuously drawn through said turbine, causing said vapor to change to a condensate, and sequentially fill each said condensation chamber and sequentially empty each condensation chamber into said reservoir.

2. The vapor condensation and liquid recovery system of claim 1 wherein said valve control means includes a computer.

3. The vapor condensation and liquid recovery system of claim 1 wherein said reservoir includes a third valved port means, said third valved port means having a open and closed position.

4. The vapor condensation and liquid recovery system of claim 3 where in said third valved port means is operatively connected by connection means to said vacuum generating means.

5. The vapor condensation and liquid recovery system of claim 4 wherein said valve control means controls the opening and the closing of said third valved port means.

6. The vapor condensation and liquid recovery system of claim 1 wherein said reservoir includes a first means to prevent overpressurization.

7. The vapor condensation and liquid recovery system of claim 6 wherein said first means includes a check valve.

8. The vapor condensation and liquid recovery system of claim 7 wherein said first means further includes a vapor scrubbing means.

9. The vapor condensation and liquid recovery system of claim 1 wherein said reservoir includes a drain means to permit the condensate to be drained from said reservoir.

10. The vapor condensation and liquid recovery system of claim 9 wherein said drain means includes a drain valve.

11. The vapor condensation and liquid recovery system of claim 1 wherein said vacuum generating means includes a pump.

12. The vapor condensation and liquid recovery system of claim 11 wherein said vacuum generating means further includes a vapor scrubbing means.

13. The vapor condensation and liquid recovery system of claim 1 wherein said turbine is connected to a load.

14. A vapor condensation and liquid recovery system comprising;

vapor generating means;

an enthalpy reducing means;

at least three condensation chambers;

said condensation chambers having a valved inlet means and a valved outlet means;

said valved inlet means connected by connection means to said enthalpy reducing means;

a vacuum generating means;

said condensation chambers having a first valved port means;

said first valved port means connected by connection means with said vacuum generating means;

a positive fluid pressure generating means;

said condensation chambers having a second valved port means;

said second valved port means connected by connection means to said positive fluid pressure generating means;

a reservoir; said reservoir connected by connection means to said valved outlet means;

a valve control means for controlling said valved inlet means, said valved outlet means and said first valve port means, and said second valved port means, whereby said valve control means opens and closes said first valved port means, said second valved port means, said valved inlet means and said valved outlet means in a sequence permitting a vapor to be continuously drawn through said enthalpy reducing means, causing said vapor to change to a condensate, and sequentially fill each said condensation chamber and sequentially empty each condensation chamber into said reservoir.

15. The vapor condensation and liquid recovery system of claim 14 wherein said reservoir includes a first means to prevent overpressurization.

16. The vapor condensation and liquid recovery system of claim 15 wherein said first means includes both a check valve and a vapor scrubbing means.

17. The vapor condensation and liquid recovery system of claim 14 wherein said reservoir includes a drain means to permit the condensate to be drained from said reservoir.

18. The vapor condensation and liquid recovery system of claim 17 wherein said drain means includes a drain valve.

19. The vapor condensation and liquid recovery system of claim 14 wherein said enthalpy reduction means includes a turbine.

20. The vapor condensation and liquid recovery system of claim 19 wherein said turbine is connected to a load.

21. The vapor condensation and liquid recovery system of claim 14 wherein said valve control means includes a computer.

22. The vapor condensation and liquid recovery system of claim 14 wherein said reservoir includes a third valved port means.

23. The vapor condensation and liquid recovery system of claim 22 wherein said third valved port means is connected by connection means to said vacuum generating means.

24. The vapor condensation and liquid recovery system of claim 1 wherein said connection means includes a pipe.

* * * * *